US006471077B1

(12) United States Patent
Johnson

(10) Patent No.: US 6,471,077 B1
(45) Date of Patent: Oct. 29, 2002

(54) NECKFORM FOR DISPLAYING JEWELRY

(75) Inventor: Larry B. Johnson, Providence, RI (US)

(73) Assignee: International Packaging Corporation, Pawtucket, RI (US)

( * ) Notice: Subject to any disclaimer, the term of this patent is extended or adjusted under 35 U.S.C. 154(b) by 0 days.

(21) Appl. No.: 09/911,214

(22) Filed: Jul. 23, 2001

(51) Int. Cl.[7] ..... A47F 7/02
(52) U.S. Cl. ..... 211/85.2
(58) Field of Search ..... 211/85.2, 13.1; 206/6.1, 471

(56) References Cited

U.S. PATENT DOCUMENTS 2,813,622 A * 11/1957 Lancellotti
3,718,260 A * 2/1973 Sharp
3,982,628 A * 9/1976 Rodenas
4,552,264 A 11/1985 Quarrell et al.
4,732,269 A * 3/1988 Roy
5,487,600 A * 1/1996 Griffin
5,671,849 A 9/1997 Bacon
5,897,416 A 4/1999 Barrows
5,913,417 A 6/1999 Ovadia
6,205,688 B1 * 3/2001 Grosser-Samuels
6,309,016 B1 * 10/2001 Aloisi
6,345,716 B1 * 2/2002 Chapman

OTHER PUBLICATIONS

Presentation Box & Display Brochure, Pawtucket, RI.

* cited by examiner

*Primary Examiner*—Alvin Chin-Shue
*Assistant Examiner*—Sarah Purol
(74) *Attorney, Agent, or Firm*—Salter & Michaelson

(57) ABSTRACT

A neckform for supporting and displaying a necklace and including an end plug member for supporting a second ornamental article thereon is disclosed. The end plug member may be removably supported within the neck form such that the end plug is interchangeable with a variety of end plugs designed to hold various articles of jewelry. The end plug may include any number of a variety of supports for displaying various articles of jewelry or other ornamental articles. For example, the end plug may include a slit for supporting the band of a ring, may include one or more apertures for supporting earrings and/or pins, and may include a wrist extension for supporting a bracelet or watch. In addition, the end plug may have multiple supports and/or holders such that more than one article of jewelry can be supported by the end plug.

15 Claims, 9 Drawing Sheets

NECKFORM FOR DISPLAYING JEWELRY

DESCRIPTION

1. Technical Field

The invention relates generally to a neckform for displaying jewelry, and more particularly, to a neckform for displaying a necklace and an additional article of jewelry.

2. Background of Related Art

When displaying necklaces, retailers often utilize a neckform to support and display the necklace to the consumer. Such neckforms are well known in the art and provide an appealing visual display by supporting a necklace in a manner similar to which it is worn. Neckforms generally include a body portion which is supported at an angle, so that the necklace is readily visible, such as through a display case. While neckforms display necklaces in an aesthetically appealing manner, they tend to be larger than other display items and take up significant amounts of space in a display area. In addition, because they provide a raised surface on which to display the necklace, they may draw the consumer's attention away from other articles which are displayed lower in the display case.

Other devices for displaying necklaces alongside other articles of jewelry are also known in the art. For example, a generally flat display pad sized to fit within a jewelry box and which includes slits for receiving a necklace is known in the art. However, such display pads do not provide the same aesthetic appeal as neckforms because they do not display the necklace in a manner similar to which it is worn.

Therefore, there is continued development in the art to create improved devices for displaying necklaces alongside other articles of jewelry in an aesthetically pleasing manner.

SUMMARY

In accordance with one aspect of the present invention, there is provided a neckform for supporting and displaying a necklace including an end plug member for supporting a second ornamental article thereon. In a preferred embodiment, the end plug member is removably supported within the neckform such that the end plug is interchangeable with a variety of end plugs designed to hold various articles of jewelry. The end plug preferably sits atop the highest part of the neckform, so that the article of jewelry supported on the plug is elevated relative to the necklace supported on the body of the neckform. The end plug may include any number of a variety of supports for displaying various articles of jewelry or other ornamental articles. For example, the end plug may include a slot for supporting the band of a ring, may include one or more apertures for supporting earrings and/or pins, and may include a wrist extension for supporting a bracelet or watch. In addition, the end plug may have multiple supports and/or holders such that more than one article of jewelry can be supported by the end plug. In a preferred embodiment, the end plug is frictionally held within a recess in the neckform. In this manner, the end plug is supported within the neckform while also being readily removable and interchangeable with other style end plugs, as desired.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A neckform 10 for supporting and displaying a necklace 12 and including an end plug 14 for supporting a second ornamental article is illustrated in FIGS. 1–9. As used herein the term "ornamental article" refers to any ornamental item, including but not limited to an article of jewelry, which is intended to be worn by a user. Also, as used herein, the term "jewelry" refers to any type or style of jewelry.

Figure 1:
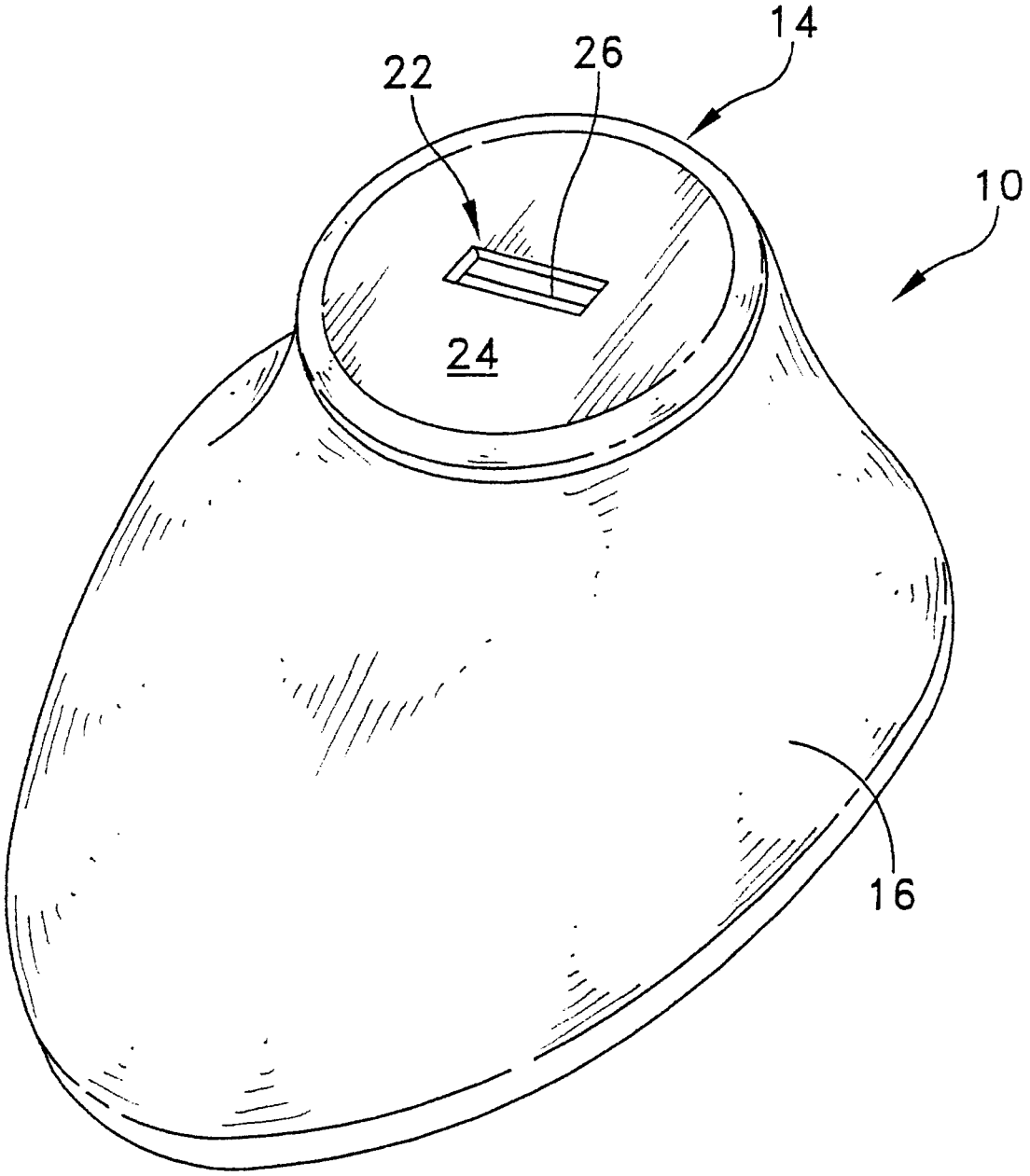
FIG. 1 is a perspective view of a neckform for supporting a necklace and an additional article of jewelry in accordance with the present invention.
Figure 2:
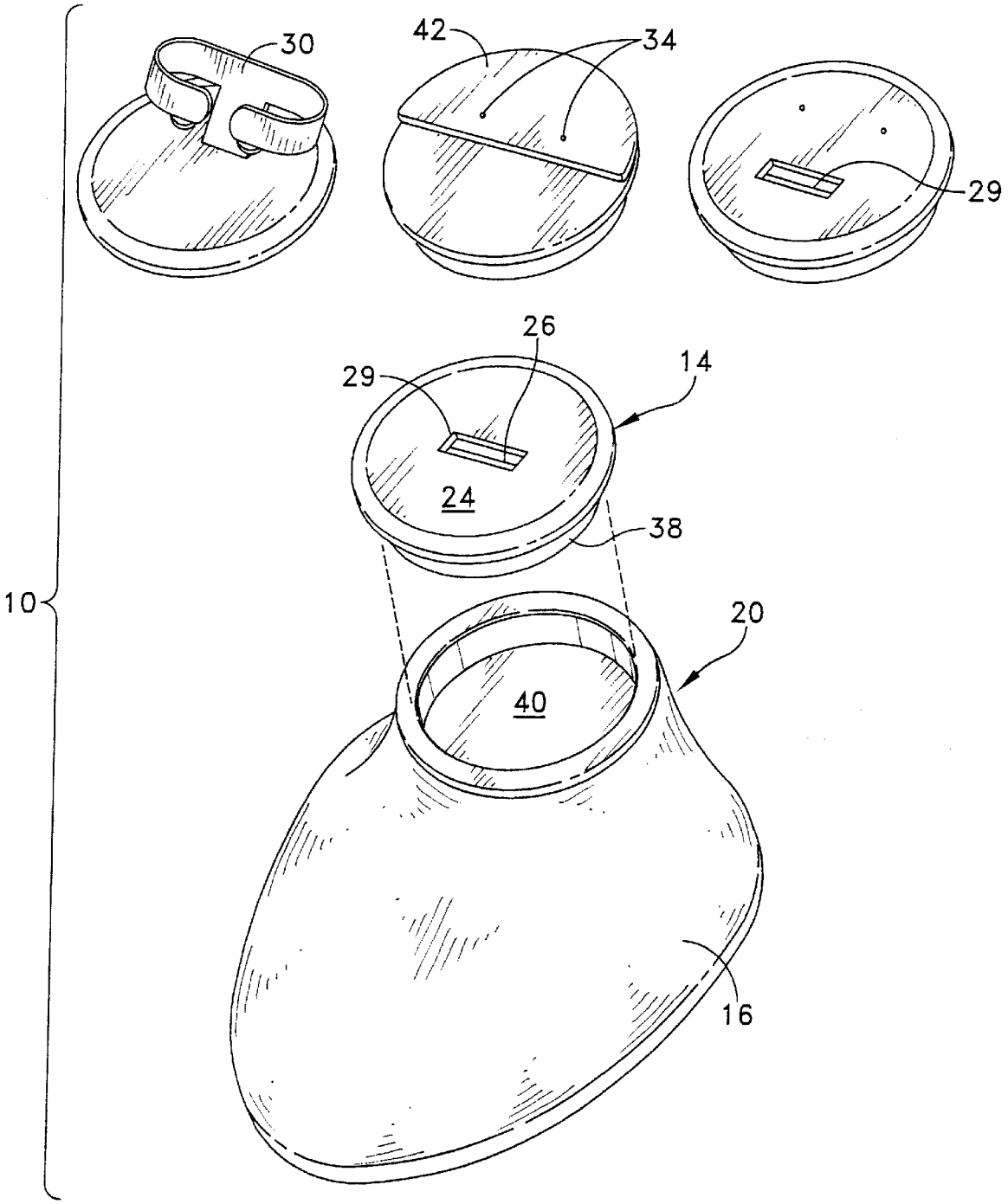
FIG. 2 is an exploded view of the neckform of FIG. 1.
Figure 3:
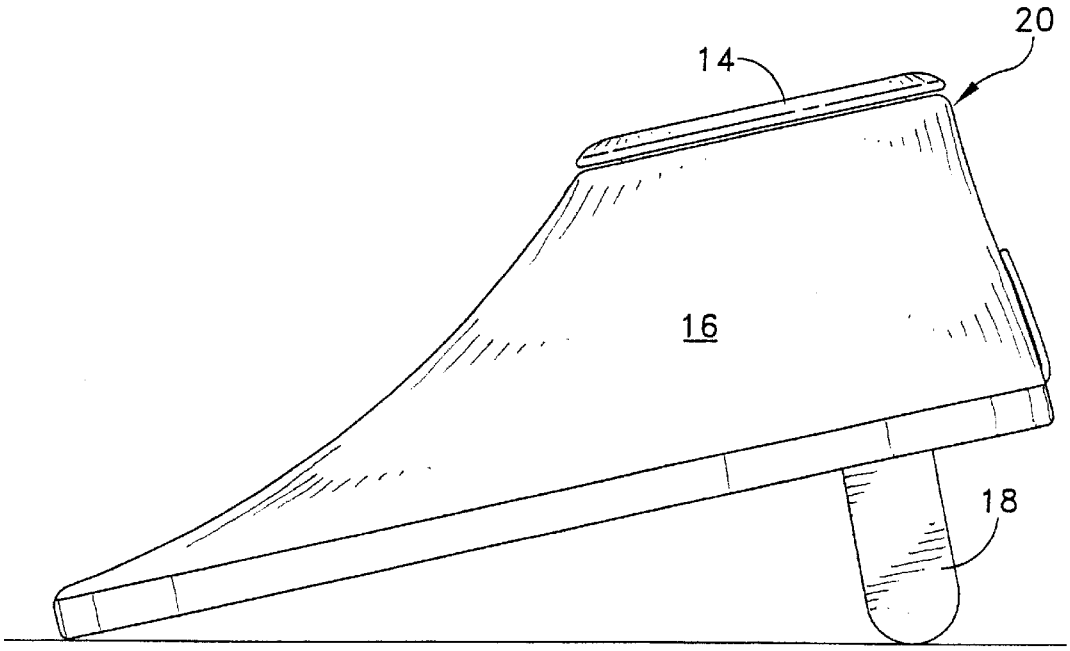
FIG. 3 is a side view of the neckform of FIG. 1.
Figure 4:
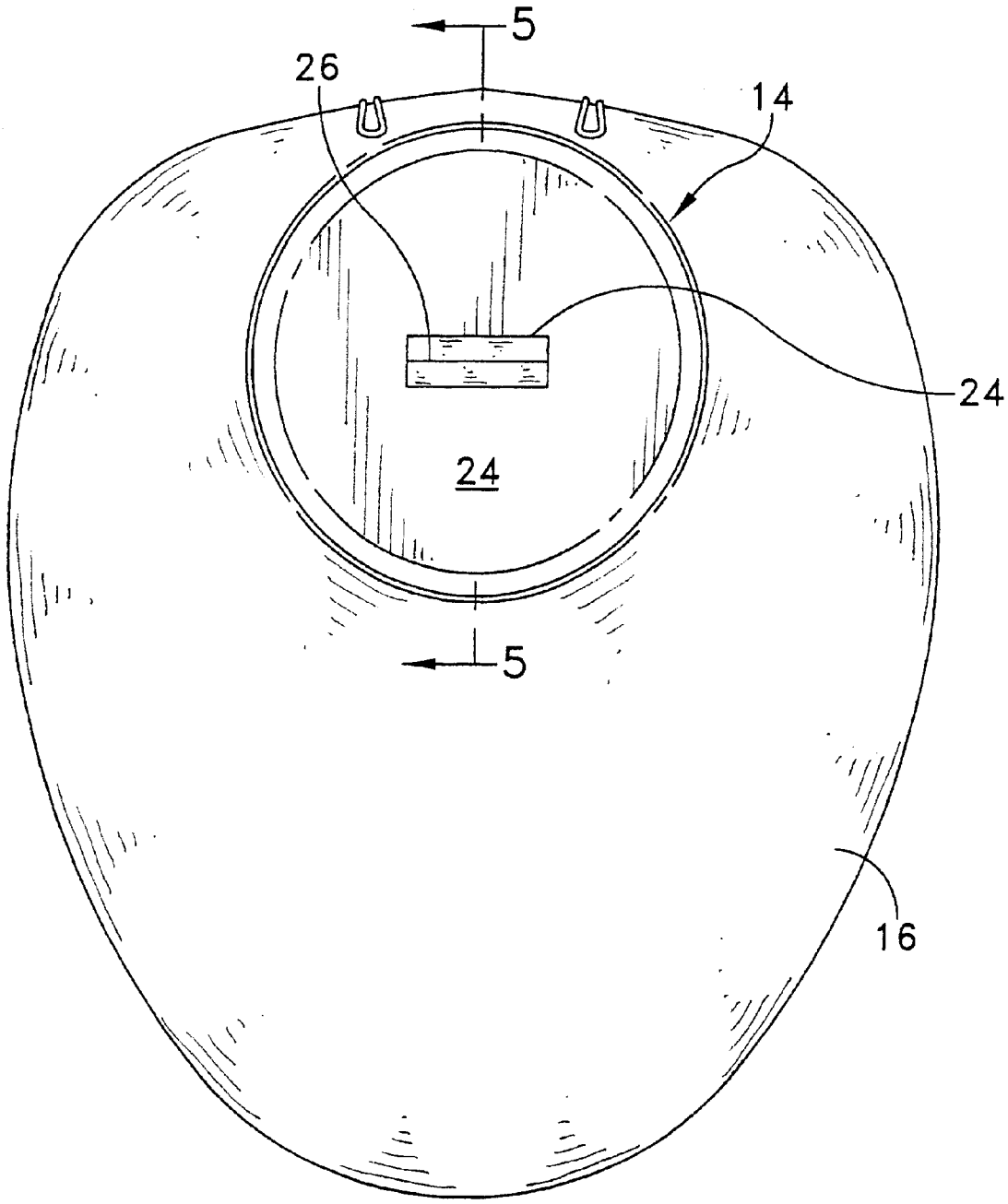
FIG. 4 is a top view of the neckform of FIG. 1.
Figure 5:
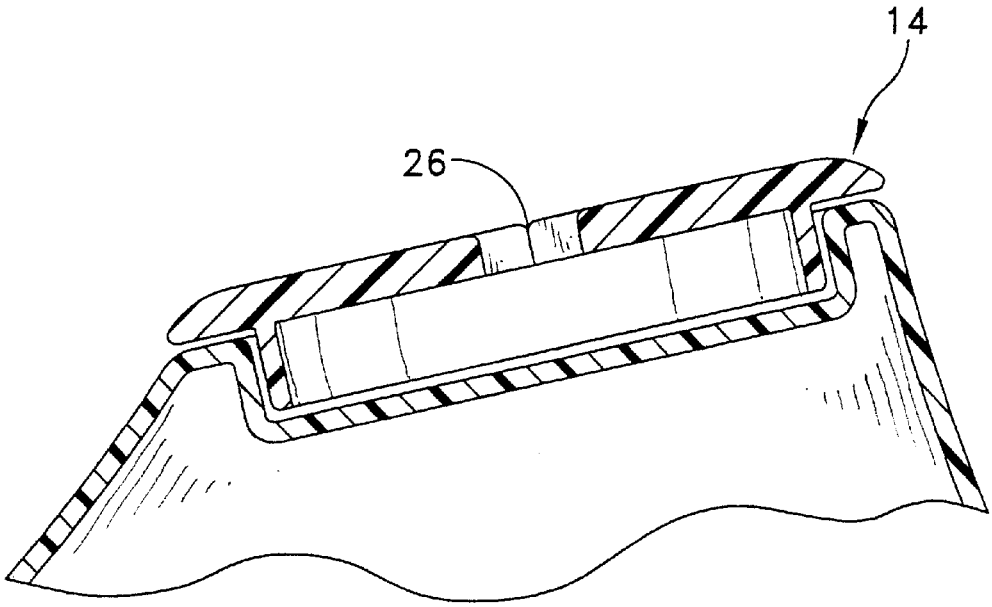
FIG. 5 is a cross-sectional view taken along lines 5—5 of FIG. 4 with the end plug inserted.
Figure 6:
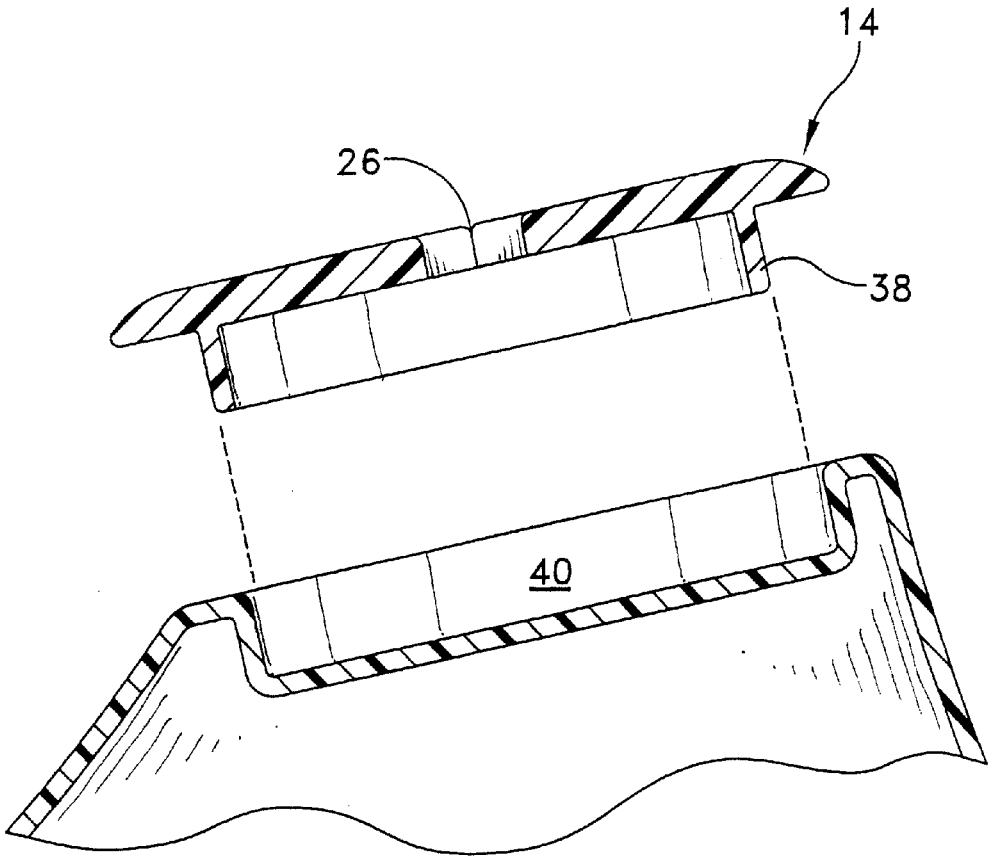
FIG. 6 is a cross-sectional view taken along line 5—5 of FIG. 4 with the end plug removed.
Figure 7:
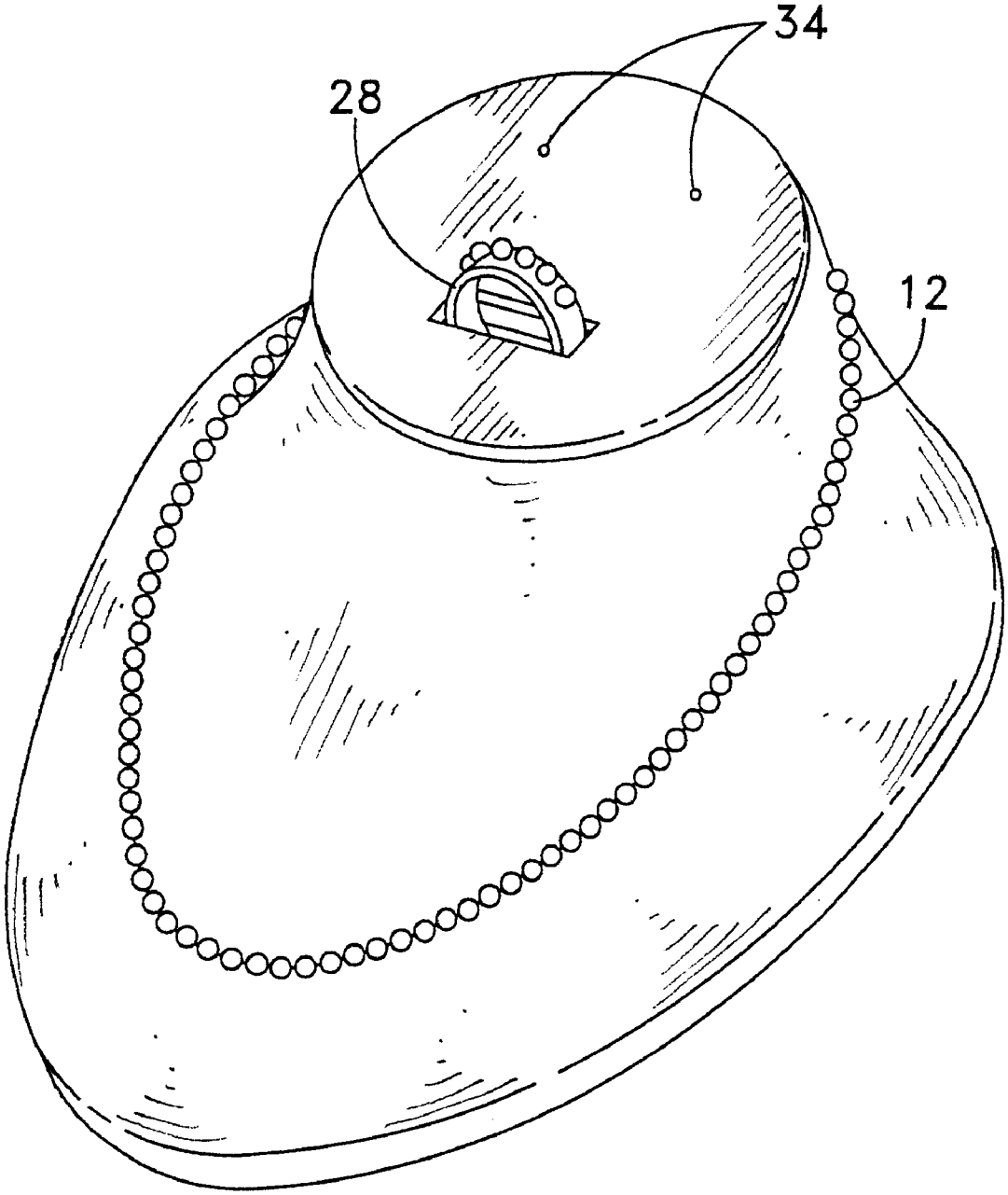
FIG. 7 is a perspective view of the neckform illustrating an exemplary end plug for supporting a ring and earrings.
Figure 8:
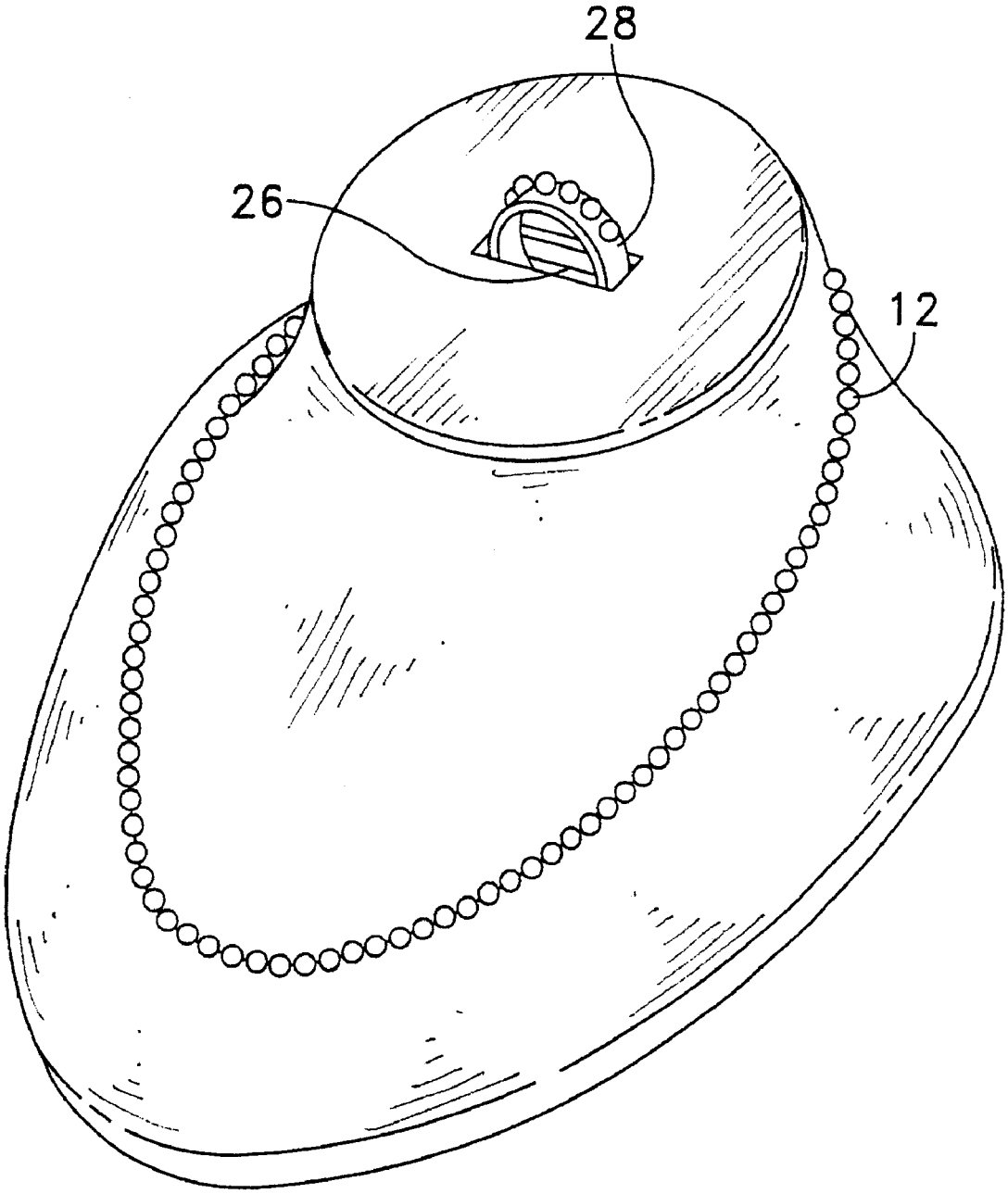
FIG. 8 is a perspective view of the neckform illustrating an exemplary end plug for supporting a ring.
Figure 9:
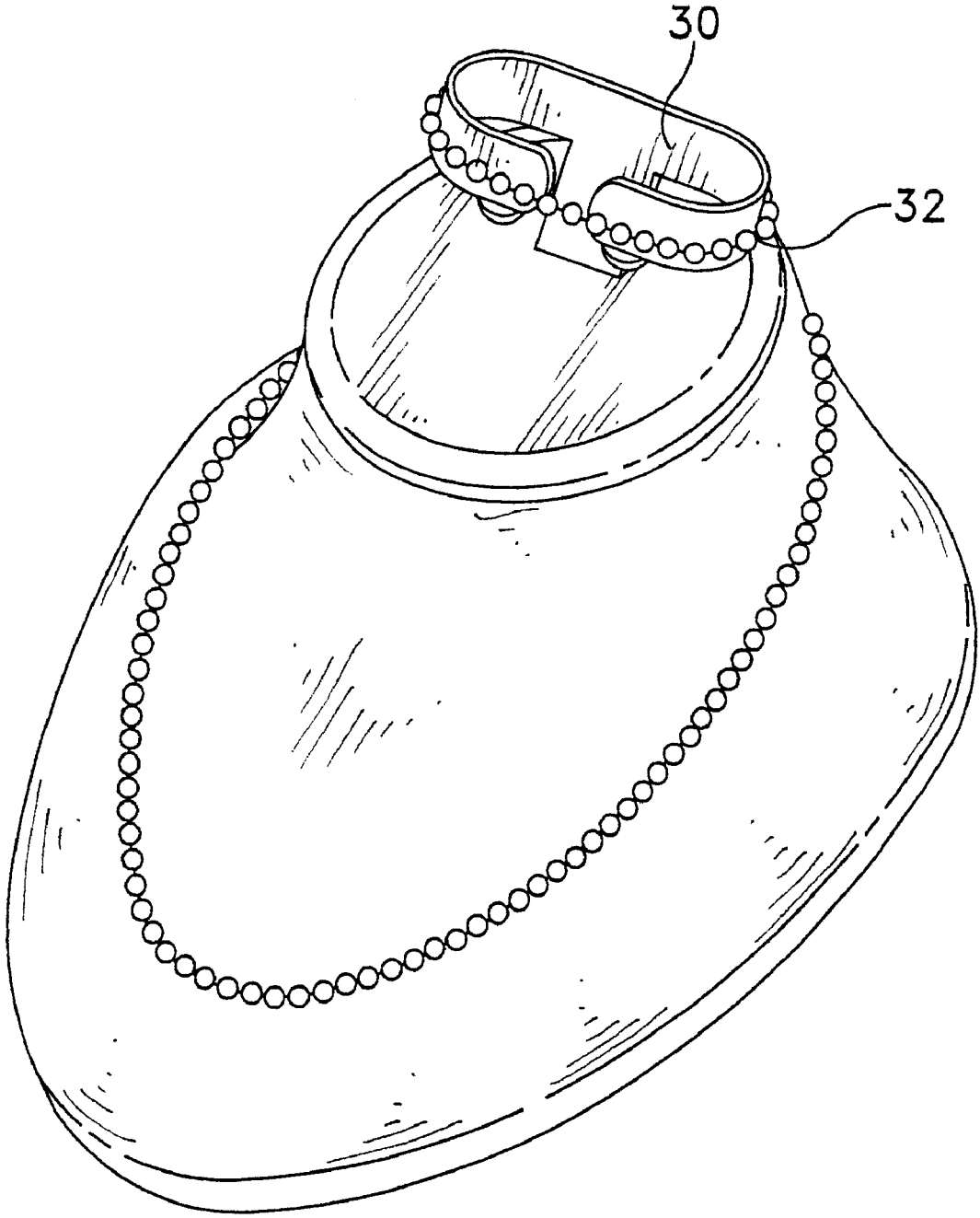
FIG. 9 is a perspective view of the neckform illustrating an exemplary end plug for supporting a bracelet and/or watch.
Figure 10:
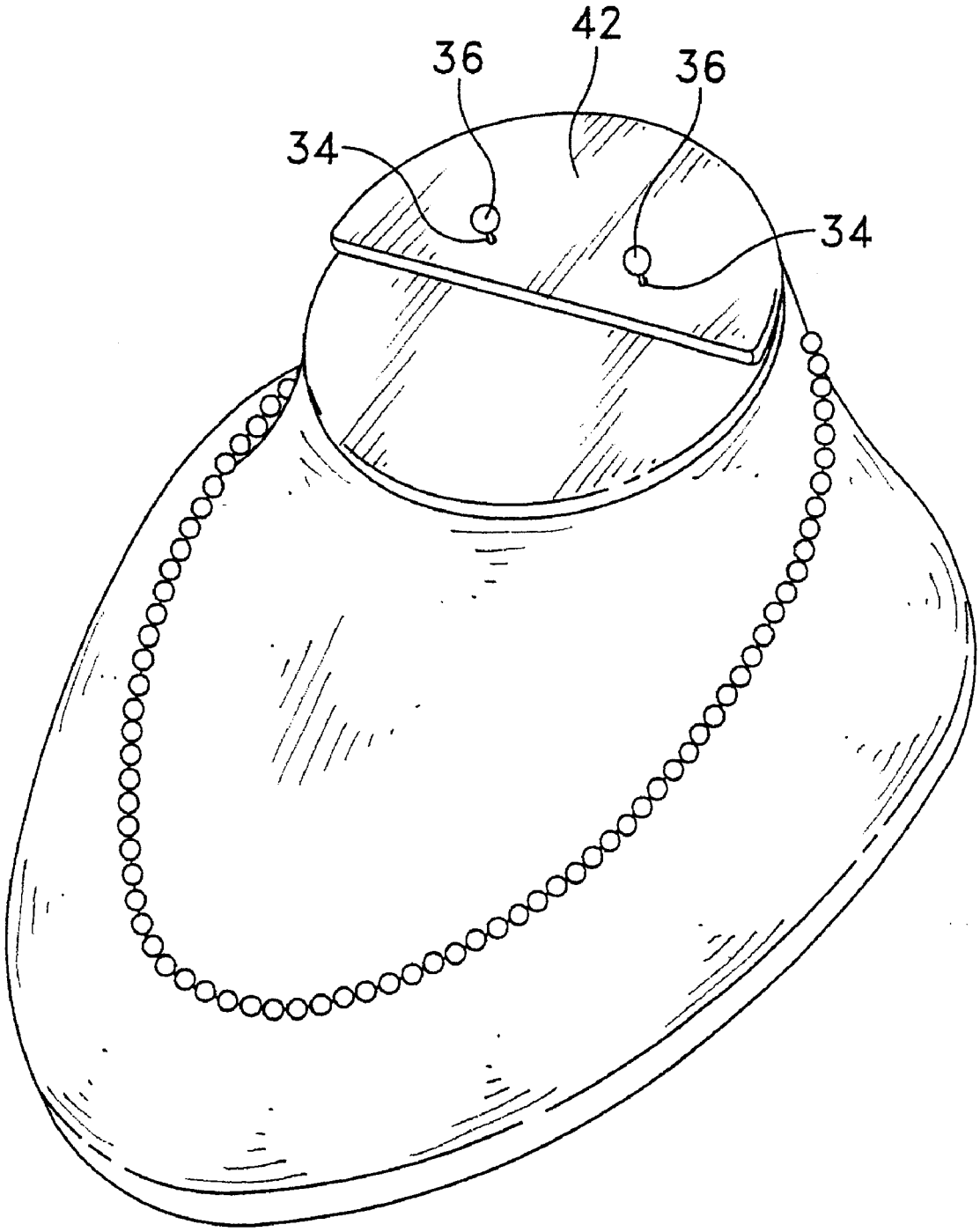
FIG. 10 is a perspective view of the neckform illustrating an exemplary end plug for supporting earrings.

The neckform 10 preferably includes a body portion 16 designed to resemble the chest and base of a neck of a person, and a stand 18 (FIG. 3) for supporting the body portion, as is known in the art. An upper end 20 of the body portion is capped by end plug 14 which includes a support member 22 for displaying an ornamental article, for example a second piece of jewelry. The end plug preferably sits atop the highest part of the neckform, so that the article of jewelry supported by the end plug is elevated relative to the necklace supported on the body of the neckform. The support member is preferably supported on or formed in an outer surface 24 of the end plug. The support member may be any of a variety of shapes and/or sizes, depending upon the particular article of jewelry to be supported. For example, the support member may be a slit 26 disposed in the end plug for supporting the band of a ring 28 (FIGS. 1–8). The support member may be a wrist extension 30 for supporting a bracelet 32 or watch (FIG. 9), or may include one or more apertures 34 for supporting earrings 36 and/or pins (FIGS. 7 and 10). The following description is in reference to the end plug illustrated in FIGS. 1–6 including ring support member or slit 26. However, it should be understood that the following description would be applicable to any support member which may be utilized with the end plug to display an ornamental article.

Referring now to FIGS. 1–6, the end plug 14 preferably includes a base 38 which is sized to fit within a recess 40 formed in the upper end 20 of the body portion 16 which may be vacuum formed using any suitable plastic material. The end plug preferably fits snugly and securely within the recess during use. In the present embodiment, the base has a circumference which is slightly smaller than the recess 40, and is adapted to frictionally fit within the recess. The end plug and the recess preferably have complementary shapes, and may both be generally circular as in the present embodiment. Alternatively, other shapes may be utilized as would be known to those of skill in the art. In order to aid the friction between the end plug and the recess, while allowing the end plug to be readily removed, the base of the end plug may be covered with textured fabric, such as flocking. The outer surface 24 of the end plug may also preferably be covered with the same material as the body portion in order to maintain a continuous appearance. In the present embodiment, the body portion and outer surface of the end plug are covered in an imitation leather, or leatherette material, while the base of the end plug is preferably covered with a flocked material. Other materials may readily be utilized, as would be known to those of skill in the art. In addition, although not preferred, the outer surface of the end plug may be covered with a different material than that of the body portion In the embodiment of FIGS. 1–6, the support member is designed to hold and display a ring and preferably includes a slot 29 formed in the outer surface 24 for accessing a slit 26 which is designed to hold the band of the ring. In the present embodiment, the slit may be expandable and formed within a piece of foam mounted in the end plug and under the slot 29. Alternatively, the support member may be designed to hold other types of jewelry, for example a bracelet or watch as shown in FIG. 9. In the embodiment of FIG. 9, the support member includes a wrist extension 30 which preferably has an oblong configuration designed to support the bracelet 32 on an outer surface thereof, above the end plug. Another exemplary support member is shown in FIG. 10 and includes one or more apertures 34 which may either be formed in the outer surface 24 of the end plug (see FIG. 7), or may be formed in an overlay member 42 attached to the end plug, for example by a hinge (not shown). Forming the apertures in the overlay member, which lays against the outer surface of the end plug during use, enables the earring and/or pin to be more easily inserted within the apertures. More than one support may be utilized on a single end plug, as illustrated in FIG. 7 which includes both a support for a ring and a support for earrings.

Use of the neckform 10 will now be described with reference to the drawings.

In use, a necklace is placed on the body of the neckform for display, as is known in the art. If the neckform includes a set of interchangeable end plugs having a variety of support members designed to support different types of jewelry, the appropriate end plug is chosen for the article to be displayed. The article to be displayed with the necklace is mounted onto the support member of the end plug, and the end plug is inserted within the recess of the neckform. The end plug may then be adjusted, as may the article supported thereon, as desired. The end plug is supported within the recess until removed. When a different article is to be displayed with the neckform the end plug is simply removed and replaced, as desired. In a preferred embodiment, the end plug is held within the recess by friction, although other means for removably securing the end plug within the recess may be utilized, for example Velcro® material.

By providing means for displaying different articles of jewelry in combination with the necklace being displayed, the consumer looking at the display receives an immediate visual impression of the appearance of an ensemble comprising the necklace and a complementary article of jewelry, thus promoting sale of not only the necklace, but rather of the entire ensemble.

It will be understood that various modifications may be made to the embodiment disclosed herein. For example, the support member may be any of a variety of shapes and/or sizes, depending upon the article to be supported, and is not limited to those specific configurations disclosed herein. Also, one of the interchangeable end plugs may have a continuous outer surface and not include a support member for those times when no other ornamental articles are displayed on the neckform with the necklace. Alternate shapes, sizes, dimensions, and materials may also be utilized, as would be known to those of skill in the art. Therefore, the above description should not be construed as limiting, but merely as exemplifications of a preferred embodiment. Those skilled in the art will envision other modifications within the scope, spirit and intent of the invention.

What is claimed is:

1. A neckform for displaying one or more articles of jewelry comprising:

a body portion constructed and arranged to support a necklace;

a first end plug including a support member constructed and arranged to support an ornamental object; and at least one additional end plug, the at least one additional end plug being interchangeable with the first end plug.

2. The neckform of claim 1, wherein the body portion includes a recess constructed and arranged to receive the base of the end plug therein.

3. The neckform of claim 2, wherein the base is removably supported within the recess so as to allow a user to selectively remove the end plug.

4. The neckform of claim 3, wherein the base is frictionally fit within the recess.

5. The neckform of claim 1, wherein the support member is selected from the group consisting of one or more apertures, a slit, and a wrist extension.

6. The neckform of claim 1, wherein the support member is formed in an outer surface of the end plug.

7. The neckform of claim 1, wherein the support member is supported on an outer surface of the end plug.

8. The neckform of claim 1, wherein the end plug further comprises an overlay member attached to the end plug, the support member being disposed on the overlay member.

9. The neckform of claim 1, further comprising a stand for supporting the body portion of the neckform.

10. A neckform for displaying one or more articles of jewelry comprising:

a body portion constructed and arranged to support a necklace;

a recess formed within the body portion on a first end thereof;

a first end plug removably disposed within the recess and including a support member constructed and arranged to support an ornamental object thereon; and at least one additional end plug, the at least one additional end plug being interchangeable with the first end plug;

wherein the end plugs are each selectively removable and replaceable from within the recess by a user.

11. The neckform of claim 10, wherein the end plug includes a base constructed and arranged to fit within the recess, the base being frictionally fit within the recess.

12. The neckform of claim 10, wherein the support member is selected from the group consisting of one or more apertures, a slit, and a wrist extension.

13. The neckform of claim 10, further comprising a stand for supporting the body portion of the neckform.

14. The neckform of claim 10, wherein the end plug further comprises an overlay member attached to the end plug, the support member being disposed on the overlay member.

15. A neckform for displaying one or more articles of jewelry comprising:

a body portion constructed and arranged to support a necklace; and a first end plug including a support member constructed and arranged to support an ornamental object, wherein the support member is selected from the group consisting of one or more apertures, a slit, and a wrist extension.

* * * * *